US005092232A

United States Patent [19]

Bergmeier

[11] Patent Number: 5,092,232

[45] Date of Patent: Mar. 3, 1992

[54] APPARATUS FOR PEELING BOILED EGGS

[75] Inventor: Erich Bergmeier, Hiddenhausen, Fed. Rep. of Germany

[73] Assignee: Erich Bergmeier Maschinenfabrik, Fed. Rep. of Germany

[21] Appl. No.: 606,469

[22] Filed: Oct. 31, 1990

[51] Int. Cl.[5] ..... A23N 5/00; A47G 19/28; A47J 43/14

[52] U.S. Cl. ..... 99/581; 99/568

[58] Field of Search ..... 99/568-571, 99/579-583; 426/482, 481, 298, 299

[56] References Cited

U.S. PATENT DOCUMENTS

| | | | |
|---|---|---|---|
| 2,527,364 | 10/1950 | Koffler | 99/568 |
| 2,535,980 | 12/1950 | Yeamans | 99/568 X |
| 3,101,146 | 8/1963 | Willsey | 99/568 |
| 3,552,458 | 1/1971 | Whitman | 99/568 X |
| 3,774,525 | 11/1973 | Driggs | 99/568 |
| 3,877,362 | 4/1975 | Epstein et al. | 99/581 |
| 4,191,102 | 3/1980 | Cope | 99/580 |
| 4,311,089 | 1/1982 | Fujii | 99/580 |
| 4,344,359 | 8/1982 | Frechou et al. | 99/582 |
| 4,686,895 | 8/1987 | Ishino et al. | 99/427 |

FOREIGN PATENT DOCUMENTS

| | | | |
|---|---|---|---|
| 0325349 | 7/1989 | European Pat. Off. | 99/568 |
| 61380 | 4/1968 | Fed. Rep. of Germany . | |
| 2445109 | 8/1980 | France | 99/568 |
| 2566648 | 1/1986 | France | 99/568 |

*Primary Examiner*—Timothy F. Simone
*Attorney, Agent, or Firm*—Laubscher Presta & Laubscher

[57] ABSTRACT

A boiled egg peeling device is provided for gently and completely removing the shell from boiled eggs. The device includes a plurality of parallel peeling rollers connected with a circulating chain drive. In the upper segment of the chain drive, the peeling rollers are driven for rotation in the same direction. Above the rollers on the upper segment of the chain drive are provided pairs of pushing plates that are reciprocated back and forth along the axes of the rollers. The eggs are rotated by the rollers about their longitudinal axis and moved back and forth by the pushing plates in the gap between the rollers, whereby the shells are gently and completely removed from the eggs.

6 Claims, 4 Drawing Sheets

APPARATUS FOR PEELING BOILED EGGS

BACKGROUND OF THE INVENTION

In the food processing industry, hard boiled eggs are put to a variety of uses. Accordingly, there is a demand for large quantities of boiled eggs. The present invention relates to an apparatus for automatically peeling the shells from boiled eggs without damaging the eggs in order to meet this demand.

BRIEF DESCRIPTION OF THE PRIOR ART

Automatic peeling devices are known in the prior art as evidenced by DD-PS 61380 which discloses a device including two spaced peeling rollers that rotate in opposite directions from each other. Because the rollers are rotated in opposite directions, products supported on the rollers are drawn into the gap therebetween. The rollers are provided with a rubber-like coating for peeling the product within the gap. This type of peeling device is suitable for peeling products having a soft outer shell or skin, such as fruits.

While the prior peeling devices such as that disclosed in DD-PS 61380 operate satisfactorily, they have certain inherent drawbacks which make them unsuitable for peeling boiled eggs. With the prior peeling devices, it would be impossible to accomplish gentle peeling of an egg because it is not possible to remove the shell from an egg in relatively small pieces. Furthermore, there is the inherent danger that the egg to be peeled might be damaged in the ga between the peeling rollers.

The present invention was developed in order to overcome these and other drawbacks of the prior devices by providing an apparatus for automatically and gently removing the entire shell from a boiled egg.

SUMMARY OF THE INVENTION

Accordingly, it is a primary object of the present invention to provide an apparatus for peeling boiled eggs including at least two parallel peeling rollers for supporting an egg therebetween, the rollers being spaced to define a gap. The rollers are rotated in the same direction by a chain drive assembly. Accordingly, an egg supported between a pair of rollers is rotated as the rollers rotate. Above the spaced rollers, there is provided an egg reciprocating assembly for axially displacing the eggs back and forth along the rollers during rotation thereof. Thus, the shell of the egg is gently removed as the egg is rotated and displaced along the peeling rollers.

The egg reciprocating assembly preferably includes a pair of push plates which are arranged in spaced relation from each other and which diverge from each other in the direction of the peeling rollers in order to define a channel that widens in the direction of the rollers. The push plates are connected with a holder plate which is connected with a crankgear for reciprocating the holder as the crankgear rotates. Because of the oblique positioning of the two pushing plates relative to each other, pressure is applied to the egg by the pushing plates by the peeling rollers to increase the efficiency of the peeling process.

BRIEF DESCRIPTION OF THE FIGURES

Other objects and advantages of the invention will become apparent from a study of the following specification, when viewed in the light of the accompanying drawing in which.

DETAILED DESCRIPTION

Figure 1:
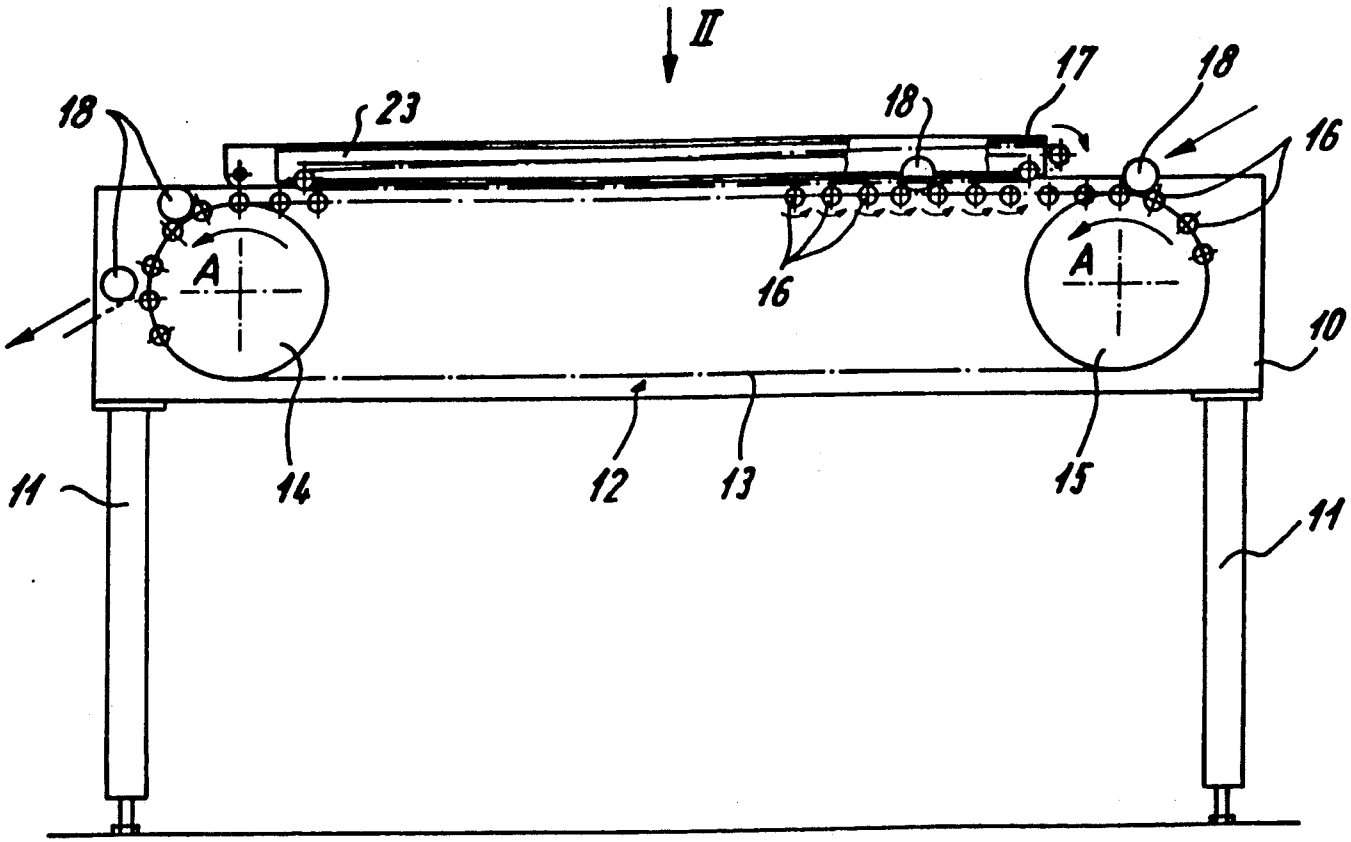
FIG. 1 is a side schematic view of the boiled egg peeling apparatus according to the invention.

Referring first to FIG. 1, the apparatus for peeling boiled eggs according to the invention includes a machine frame 10 supported by a plurality of legs 11. A rotating chain drive 12 includes a chain 13 and two diversion chain sprockets 14, 15 connected with the frame. The two sprockets 14, 15 are driven in a counterclockwise direction as shown by the arrows A by a motor (not shown) in a conventional manner well known in the art.

Connected with the chain 13 of the chain drive assembly 12 are a plurality of peeling rollers 16 that are arranged in spaced relation with parallel axes. Above the upper segment of the chain drive assembly 12 is provided a second chain drive assembly 17 for rotating the peeling rollers 16. The direction of rotation of the peeling rollers 16 is also counterclockwise as shown in FIG. 1. The eggs to be peeled are supplied at the right side of the peeling apparatus as shown in FIG. 1 and removed from the left side of the chain drive assembly 12 in a manner known in the art. For the sake of simplicity, the eggs are symbolically illustrated as circles and labeled with reference numeral 18. The peeling rollers 16 associated with the upper segment of the chain drive assembly 12 constitute a horizontally running peeling track for the eggs 18.

The second chain drive assembly 17 and its operation for rotating the peeling rollers 16 will be described with reference to FIG. 3. As shown therein, each peeling roller 16 includes a through-shaft 19 along the axis thereof. An outer sleeve 20 is provided on the shaft 18 to form the peeling surface of the roller. The sleeve is preferably made of rubber or a rubber-like synthetic material, so that the rollers have a high co-efficient of friction with respect to the shell of the egg. A chain sprocket 21 is mounted on the shaft 19 of each roller. The lower segment of the second chain drive 17 runs along and engages the chain sprocket 21 connected with each roller shaft. The peeling rollers 16 are thus driven for rotation only when their chain sprockets 21 engage the second chain drive assembly 17. This is the case when the peeling rollers are in the area of the upper segment of the chain drive assembly 12.

Figure 3:
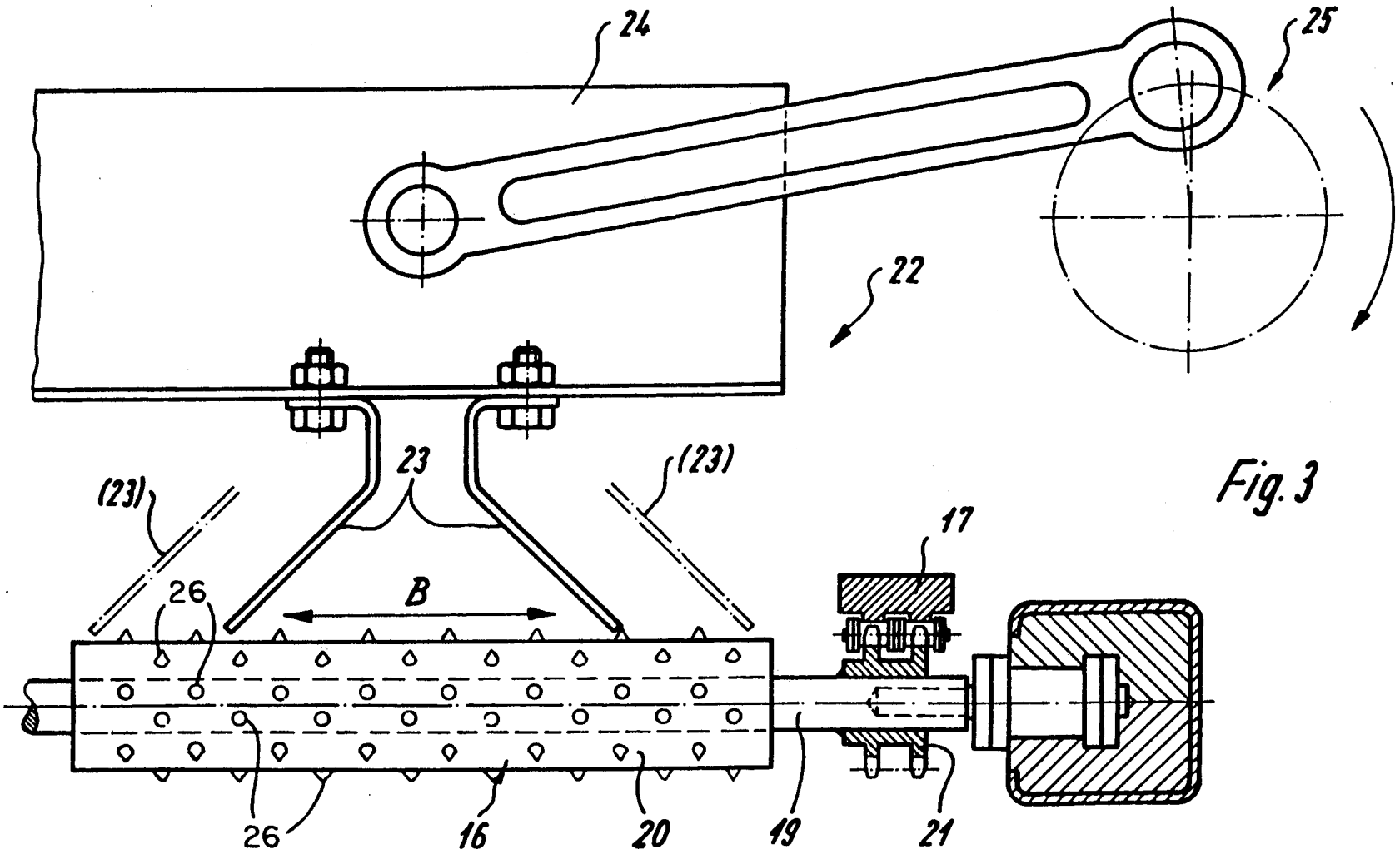
FIG. 3 is a detailed plan view of the egg reciprocating apparatus arranged adjacent to the peeling rollers.

Also shown in FIG. 3 is a pushing and pickup assembly 22 arranged above the peeling rollers 16. The pushing and pickup assembly includes a pair of pushing plates 23 that are spaced from each other and connected with a holder member 24. The holder member 24 is in turn connected with a crank gear 25 schematically illustrated in FIG. 3. As the crank gear rotates, the holder member 24 is reciprocated back and forth in the direction of the arrow B. As the holder member 24 is reciprocated, the pushing plates 23 are also reciprocated between the positions shown in FIG. 3.

The pushing plates diverge from each other in the direction toward the peeling rollers 16 as shown in FIG. 3, thereby to define a channel that is wider at the bottom in the direction toward the peeling rollers. The two terminal positions during reciprocating movement of the pushing plates are indicated in FIG. 3 by the broken lines. The interval between the pushing plates corresponds with at least the length of the egg to be peeled.

Figure 2:
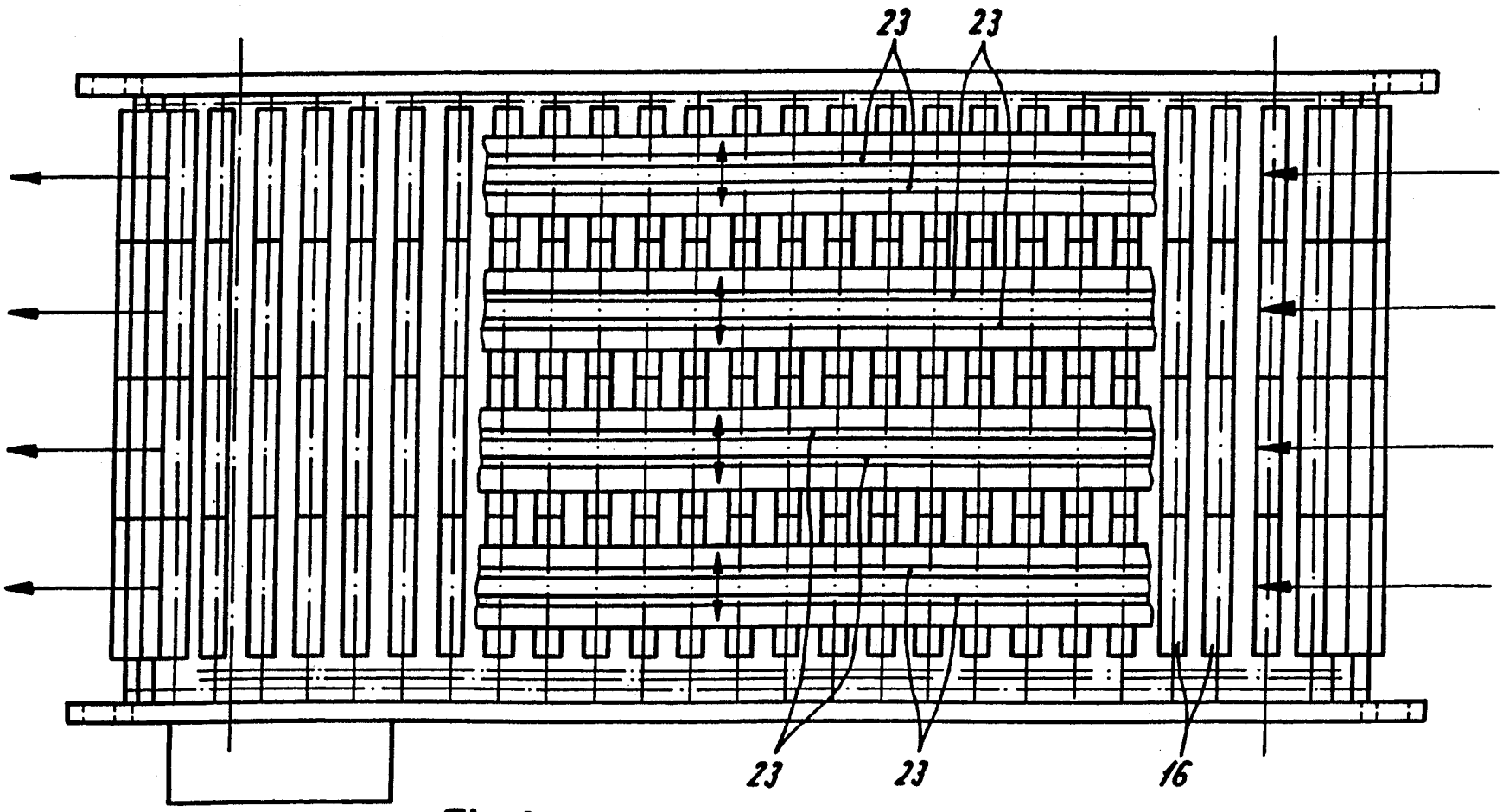
FIG. 2 is a top view of the peeling apparatus of FIG. 1.

Referring now to FIG. 2, it is shown that the peeling rollers 16 are long enough that several eggs can be deposited along the length of the rollers. Accordingly, several pair of pushing plates 23 are provided along the peeling rollers 16 so that different peeling channels are formed for the eggs lying next to each on the rollers. In the examples shown, four peeling devices are arranged next to each other, although it will be apparent to those skilled in the art that any suitable number of peeling channels can be provided by adding or subtracting additional pairs of peeling plates.

Figure 4:
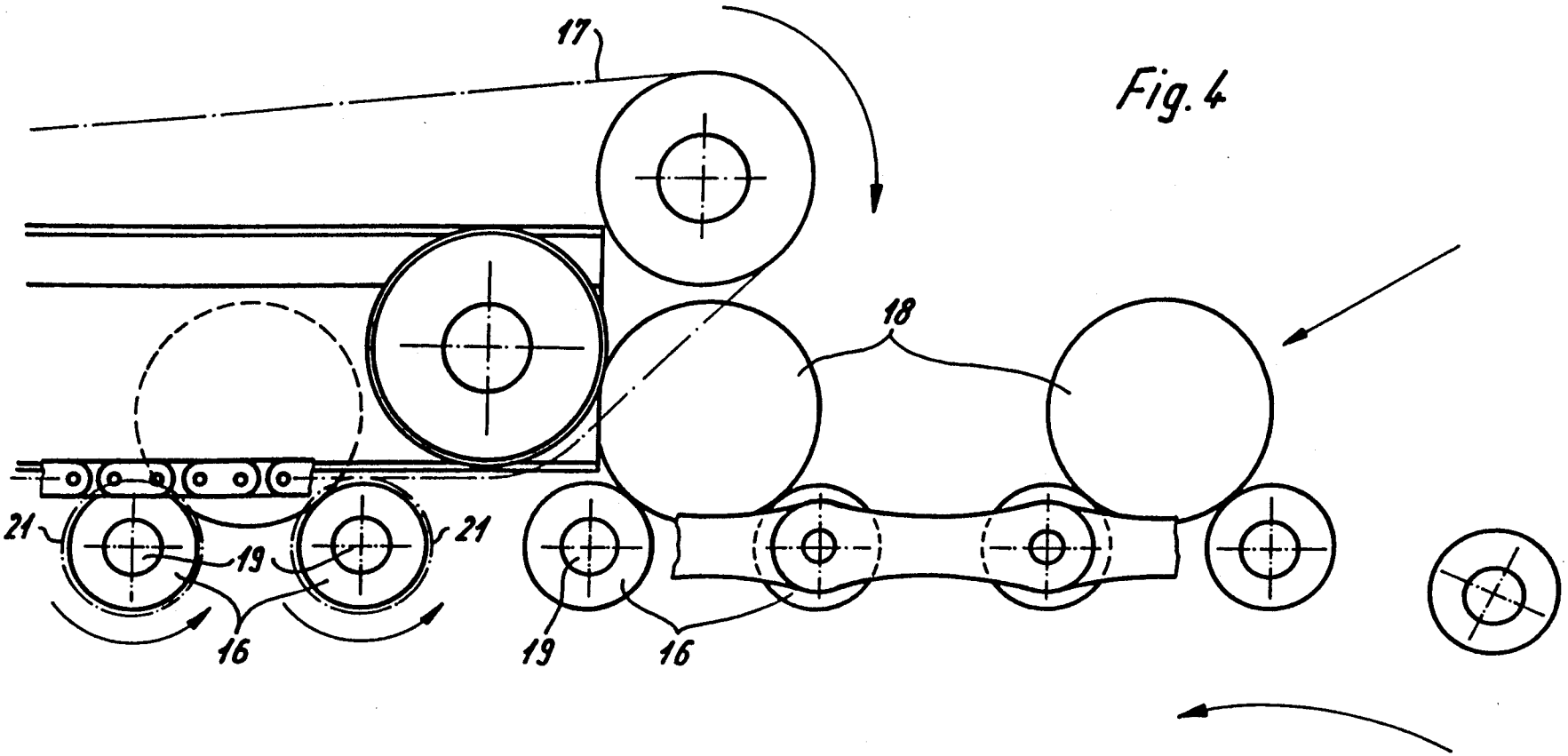
FIG. 4 is a side diagrammatic representation illustrating the feeding of the eggs on the peeling rollers between the pushing plates.

As shown in FIG. 4, the eggs to be peeled are inserted between adjacent pairs of peeling rollers 16. Between these rollers, the eggs are constantly turned as the rollers rotate and, at the same time, they are reciprocated back and forth by the pushing plates 23 parallel to the axes of the two peeling rollers. As a result, there is a complete separation of the egg shell from the boiled egg, whereby the length of the conveying track of the upper segment of the first chain drive assembly 12 insures that an egg that is to be peeled will remain between two peeling rollers for a sufficiently long period of time to allow for the complete removal of the egg shell.

Because several peeling channels can be arranged next to each other, a device can be provided with a high peeled egg output, without the need for any additional structure.

Referring once again to FIG. 3, the outer sleeve 20 of the peeling roller can be provided with a plurality of bumps 26 to increase the frictional engagement of the roller surface with the egg shell. Alternatively, any type of knurled or cammed surface can be provided on the sleeve of the peeling rollers.

The boiled egg peeling apparatus according to the invention provides an uncomplicated mechanical structure because, in addition to the pairs of peeling rollers, only a relatively simple pushing and pickup assembly is required. Such a peeling assembly gently and completely peels the shell from a boiled egg as the egg is constantly rotated between the pair of peeling rollers and simultaneously pushed back and forth in the gap between the rollers by the pushing plate assembly. Owing to the friction forces between the egg shell and the peeling rollers, complete removal of the egg shell is achieved during the rotating and reciprocating movement of the egg without the egg being damaged. The egg shells fall downwardly between the rollers and can be collected and removed in any desired manner.

While in accordance with the provisions of the patent statute, the preferred forms and embodiments of the invention have been illustrated and described, it will be apparent to those of ordinary skill in the art that various changes or modifications may be made without deviating from the inventive concepts set forth above.

What is claimed is:

1. Apparatus for peeling boiled eggs, comprising (a) at least two parallel peeling rollers for supporting an egg therebetween, said rollers being spaced to define a gap;

(b) means for rotating said rollers in the same direction, thereby to rotate the egg;

(c) egg reciprocating means arranged above said rollers for axially displacing the egg back and forth along said rollers during rotation thereof, said egg reciprocating means comprising a pair of spaced push plates which diverge relative to each other in the direction of said peeling rollers to define a channel that widens in the direction of said rollers, whereby the shell of the egg is gently removed during rotation and displacement of the egg.

2. Apparatus as defined in claim 1, and further comprising a holder member (24) and a crankgear (25) connected with said holder member for reciprocating said holder member, said plates being connected with said holder member.

3. Apparatus as defined in claim 1, herein said rollers are arranged on a chain drive (12), said push plates extending over the entire length of an upper segment of said chain drive.

4. Apparatus as defined in claim 1, wherein said peeling rollers have a sufficient length to support a plurality of eggs, one pair of push plates being provided for each egg.

5. Apparatus as defined in claim 1, wherein said peeling rollers have a surface formed of a material having a high coefficient of friction with respect to the egg shells.

6. Apparatus as defined in claim 5, wherein said rollers have bumpy surfaces.

* * * * *